US007896106B2

(12) United States Patent
Gavia

(10) Patent No.: US 7,896,106 B2
(45) Date of Patent: Mar. 1, 2011

(54) ROTARY DRAG BITS HAVING A PILOT CUTTER CONFIGURATON AND METHOD TO PRE-FRACTURE SUBTERRANEAN FORMATIONS THEREWITH

(75) Inventor: David Gavia, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 153 days.

(21) Appl. No.: 11/862,440

(22) Filed: Sep. 27, 2007

(65) Prior Publication Data

US 2008/0135297 A1 Jun. 12, 2008

Related U.S. Application Data

(60) Provisional application No. 60/873,349, filed on Dec. 7, 2006.

(51) Int. Cl.
*E21B 10/26* (2006.01)
*E21B 10/43* (2006.01)

(52) U.S. Cl. ..... 175/57; 175/391; 175/431

(58) Field of Classification Search ..... 175/57, 175/391, 431

See application file for complete search history.

(56) References Cited

U.S. PATENT DOCUMENTS

| | | | |
|---|---|---|---|
| 3,707,747 | A | 1/1973 | Falk |
| 4,471,845 | A | 9/1984 | Jurgens |
| 4,538,690 | A | 9/1985 | Short, Jr. |
| 4,602,691 | A | 7/1986 | Weaver |
| 4,815,342 | A | 3/1989 | Brett et al. |
| 4,892,159 | A | 1/1990 | Holster |
| 4,981,184 | A | 1/1991 | Knowlton et al. |
| 5,010,789 | A | 4/1991 | Brett et al. |
| 5,119,892 | A | 6/1992 | Clegg et al. |
| 5,131,478 | A | 7/1992 | Brett et al. |
| 5,145,017 | A | 9/1992 | Holster et al. |
| 5,238,075 | A | 8/1993 | Keith et al. |
| RE034,435 | E | 11/1993 | Warren et al. |
| 5,314,033 | A | 5/1994 | Tibbitts |
| 5,332,051 | A | 7/1994 | Knowlton |

(Continued)

FOREIGN PATENT DOCUMENTS

| | | |
|---|---|---|
| EP | 0872625 | 10/1998 |

(Continued)

OTHER PUBLICATIONS

PCT International Search Report, for International Application No. PCT/US2007/025101, mailed Jun. 19, 2008.

(Continued)

*Primary Examiner* — Shane Bomar
*Assistant Examiner* — Robert E Fuller
(74) *Attorney, Agent, or Firm* — TraskBritt

(57) ABSTRACT

A rotary drag bit exhibiting enhanced cutting efficiency and extended life is provided. The rotary drag bit comprises a bit body having a face surface, and a plurality of cutters coupled to the face surface of the bit body. The plurality of cutters comprises at least one pilot cutter and a rotationally trailing larger, primary cutter at substantially the same radius and, optionally of slightly less exposure. The pilot cutter is sized and positioned to pre-fracture the formation and perform an initial cut, while the primary cutter removes weakened, remaining formation material along the same rotational path. A method to pre-fracture subterranean formations using a rotary drag bit having a pilot cutter configuration is also provided.

24 Claims, 11 Drawing Sheets

U.S. PATENT DOCUMENTS

| | | | | |
|---|---|---|---|---|
| 5,443,565 | A | 8/1995 | Strange, Jr. | |
| 5,531,281 | A | 7/1996 | Murdock | |
| 5,549,171 | A | 8/1996 | Mensa-Wilmot et al. | |
| 5,582,261 | A | 12/1996 | Keith et al. | |
| 5,595,252 | A | 1/1997 | O'Hanlon | |
| 5,607,025 | A * | 3/1997 | Mensa-Wilmot et al. | 175/431 |
| 5,722,499 | A | 3/1998 | Nguyen et al. | |
| 5,816,346 | A * | 10/1998 | Beaton | 175/431 |
| 5,904,213 | A | 5/1999 | Caraway et al. | |
| 5,937,958 | A | 8/1999 | Mensa-Wilmot et al. | |
| 5,957,227 | A | 9/1999 | Besson et al. | |
| 5,992,547 | A * | 11/1999 | Caraway et al. | 175/385 |
| 6,123,161 | A * | 9/2000 | Taylor | 175/397 |
| 6,283,233 | B1 | 9/2001 | Lamine et al. | |
| 6,298,930 | B1 | 10/2001 | Sinor et al. | |
| 6,308,790 | B1 | 10/2001 | Mensa-Wilmot et al. | |
| 6,349,780 | B1 | 2/2002 | Beuershausen | |
| 6,394,200 | B1 * | 5/2002 | Watson et al. | 175/385 |
| 6,408,958 | B1 | 6/2002 | Isbell et al. | |
| 6,460,631 | B2 | 10/2002 | Dykstra et al. | |
| 6,510,906 | B1 | 1/2003 | Richert et al. | |
| 6,536,543 | B2 | 3/2003 | Meiners et al. | |
| 6,564,886 | B1 | 5/2003 | Mensa-Wilmot et al. | |
| 6,659,207 | B2 * | 12/2003 | Hoffmaster et al. | 175/391 |
| 6,711,969 | B2 | 3/2004 | Meiners et al. | |
| 6,729,420 | B2 | 5/2004 | Mensa-Wilmot | |
| 6,779,613 | B2 | 8/2004 | Dykstra et al. | |
| 6,883,623 | B2 | 4/2005 | McCormick et al. | |
| 6,935,441 | B2 | 8/2005 | Dykstra et al. | |
| 7,000,715 | B2 | 2/2006 | Sinor et al. | |
| 7,025,156 | B1 | 4/2006 | Caraway | |
| 7,096,978 | B2 | 8/2006 | Dykstra et al. | |
| 7,178,609 | B2 | 2/2007 | Hart et al. | |
| 7,243,745 | B2 | 7/2007 | Skeem et al. | |
| 7,594,554 | B2 | 9/2009 | Schwefe et al. | |
| 7,621,348 | B2 | 11/2009 | Hoffmaster et al. | |
| 2006/0070771 | A1 | 4/2006 | McClain et al. | |
| 2006/0162968 | A1 | 7/2006 | Durairajan et al. | |
| 2006/0180356 | A1 | 8/2006 | Durairajan et al. | |
| 2007/0144789 | A1 | 6/2007 | Johnson et al. | |
| 2007/0240905 | A1 | 10/2007 | Mensa-Wilmot | |
| 2007/0267227 | A1 | 11/2007 | Mensa-Wilmot | |
| 2008/0179106 | A1 * | 7/2008 | Gavia et al. | 175/431 |
| 2008/0179107 | A1 | 7/2008 | Doster | |
| 2008/0179108 | A1 * | 7/2008 | McClain et al. | 175/431 |
| 2009/0266619 | A1 | 10/2009 | Durairajan et al. | |
| 2010/0000800 | A1 | 1/2010 | Chen et al. | |

FOREIGN PATENT DOCUMENTS

| | | |
|---|---|---|
| EP | 0884449 | 12/1998 |
| GB | 2294072 | 4/1996 |
| GB | 2365893 | 2/2002 |
| GB | 2438053 A | 11/2007 |
| WO | 9603567 | 2/1996 |

OTHER PUBLICATIONS

PCT International Search Report for International Application No. PCT/US2008/052128, mailed Jul. 2, 2008.

PCT International Search Report for International Application No. PCT/US2008/000914, mailed Jul. 7, 2008.

PCT International Search Report for International Application No. PCT/US2008/052128, mailed Jul. 8, 2008.

* cited by examiner

ROTARY DRAG BITS HAVING A PILOT CUTTER CONFIGURATON AND METHOD TO PRE-FRACTURE SUBTERRANEAN FORMATIONS THEREWITH

CROSS-REFERENCE TO RELATED APPLICATION

This application claims the benefit of the filing date of U.S. Provisional Patent Application Ser. No. 60/873,349, filed Dec. 7, 2006, for "ROTARY DRAG BITS HAVING A PILOT CUTTER CONFIGURATION AND METHOD TO PRE-FRACTURE SUBTERRANEAN FORMATIONS THEREWITH," the entire contents of which is hereby incorporated herein by this reference.

This application is also related to U.S. patent application Ser. No. 12/019,814, filed Jan. 25, 2008, for ROTARY DRAG BIT, which claims the benefit of U.S. Provisional Patent Application Ser. No. 60/897,457 filed Jan. 25, 2007, for ROTARY DRAG BIT. This application is also related to U.S. patent application Ser. No. 12/020,399, filed Jan. 25, 2008, for ROTARY DRAG BIT AND METHODS THEREFOR, which claims the benefit of U.S. Provisional Patent Application Ser. No. 60/897,457 filed Jan. 25, 2007, for ROTARY DRAG BIT. This application is also related to U.S. patent application Ser. No. 12/020,492, filed Jan. 25, 2008, for ROTARY DRAG BIT AND METHODS THEREFOR, which claims the benefit of U.S. Provisional Patent Application Ser. No. 60/897,457 filed Jan. 25, 2007, for ROTARY DRAG BIT.

FIELD OF THE INVENTION

The present invention, in several embodiments, relates generally to a rotary drag bit for drilling subterranean formations and, more particularly, to rotary drag bits having at least one cutter set including a pilot cutter and a rotationally trailing primary cutter, and a method for pre-fracturing subterranean formations therewith.

BACKGROUND

Rotary drag bits have been used for subterranean drilling for many decades, and various sizes, shapes, and patterns of natural and synthetic diamonds have been used on drag bit crowns as cutting elements. A drag bit can provide an improved rate of penetration (ROP) over a roller cone bit or impregnated diamond drill bit in many formations.

Over the past few decades, rotary drag bit performance has been improved with the use of a polycrystalline diamond compact (PDC) cutting element or cutter, comprised of a planar diamond cutting element or table formed onto a tungsten carbide substrate under high temperature and high pressure conditions. The PDC cutters are formed into a myriad of shapes including, circular, semicircular or tombstone, which are the most commonly used configurations. Typically, the PDC diamond tables are formed so the edges of the table are coplanar with the supporting tungsten carbide substrate or the table may overhang or be undercut slightly, forming a "lip" at the trailing edge of the table in order to improve the wear life of the cutter as it comes into formations being drilled. Bits carrying PDC cutters, which for example, may be brazed into pockets in the bit face, pockets in blades extending from the face, or mounted to studs inserted into the bit body, have proven very effective in achieving high ROP in drilling subterranean formations exhibiting low to medium compressive strengths. The PDC cutters have provided drill bit designers a wide variety of improved cutter deployments and orientations, crown configurations, facilitated optimal nozzle placements and other design alternatives previously not possible with small natural diamond or synthetic diamond cutters. While the PDC cutting element improves drill bit efficiency in drilling many subterranean formations, however, the PDC cutting element is nonetheless prone to wear when operationally exposed to drilling conditions and lessens the life of a rotary bit.

Thermally stable diamond (TSP) is another synthetic diamond, PDC material which can be used as a cutting element or cutter for a rotary drag bit. TSP cutters, which have had catalyst used to promote formation of diamond-to-diamond bonds in the structure removed therefrom, have improved thermal performance over PDC cutters. The high frictional heating associated with hard and abrasive rock drilling applications, creates cutting edge temperatures that exceed the thermal stability of PDC, whereas TSP cutters remains stable at higher operating temperatures. This characteristic also enables them to be furnaced into the face of a matrix-type rotary drag bit.

While the PDC or TSP cutting elements provide better ROP and manifest less wear during drilling as compared to some other cutting element types, it is still desirous to further the life of rotary drag bits and improve cutter life regardless of the cutter type used. Researchers in the industry have long recognized that as the cutting elements wear, i.e., wearflat surfaces develop and are formed on each cutting element coming in contact with the subterranean formation during drilling, the penetration rate (or ROP) decreases. The decrease in the penetration rate is a manifestation that the rotary drag bit is wearing out, particularly when other drilling parameters remain constant. Various drilling parameters include formation type, WOB, cutter position or rake angle, cutter count, cutter density, drilling temperature and RPM, for example, without limitation, and further include other parameters understood by a person of skill in the subterranean drilling art.

While researchers continue to develop and seek out improvements for longer lasting cutters or generalized improvements to cutter performance, they fail to accommodate or implement an engineered approach to achieving longer drag bit life by maintaining or increasing penetration rate or ROP by taking advantage of cutting element wear rates. In this regard, while ROP is many times a key attribute in identifying aspects of the drill bit performance, it would be desirable to utilize or take advantage of the cutting element wear in extending or improving the life of the drag bit.

Accordingly, there is an ongoing desire to improve or extend rotary drag bit life regardless of the subterranean formation type being drilled. There is a further desire to extend the life of a rotary drag bit by beneficially orienting and positioning cutters upon the bit body.

BRIEF SUMMARY OF THE INVENTION

Accordingly, a rotary drag bit having a pilot cutter configuration is provided. The rotary drag bit life is extended by the pilot cutter configuration, making the bit more durable and extending the life of the cutting elements. Further, the pilot cutter configuration on the rotary drag bit improves fracturing of subterranean formation material being drilled, providing improved bit life and reduced stress upon the cutters.

In accordance with an embodiment of the invention, a rotary drag bit configured for formation fracturing is provided. The rotary drag bit comprises a bit body having a face, and a plurality of cutters coupled to the face surface of the bit body. The plurality of cutters comprises at least one pilot cutter and a primary cutter rotationally following the at least one pilot cutter. The at least one pilot cutter is of smaller lateral extent than the primary cutter and may be exposed to a greater extent than the primary cutter to pre-fracture and clear a portion of the formation being drilled before contact therewith of the primary cutter during drilling.

In other embodiments of the invention, a rotary drag bit having improved life is provided. The rotary drag bit comprises a bit body and at least one cutter set comprising a pilot cutter and a rotationally trailing primary cutter coupled to the bit body.

In further embodiments of the invention, a bit body comprising at least one blade, at least one fluid course rotationally leading a pilot cutter coupled to the blade and adjacent the fluid course, and a primary cutter coupled to the blade rotationally following the pilot cutter and rotationally removed from the fluid course.

A method to drill subterranean formations using a rotary drag bit having a pilot cutter configuration is also provided.

Other advantages and features of the present invention will become apparent when viewed in light of the detailed description of the various embodiments of the invention when taken in conjunction with the attached drawings and appended claims.

DETAILED DESCRIPTION OF THE INVENTION

Figure 1:
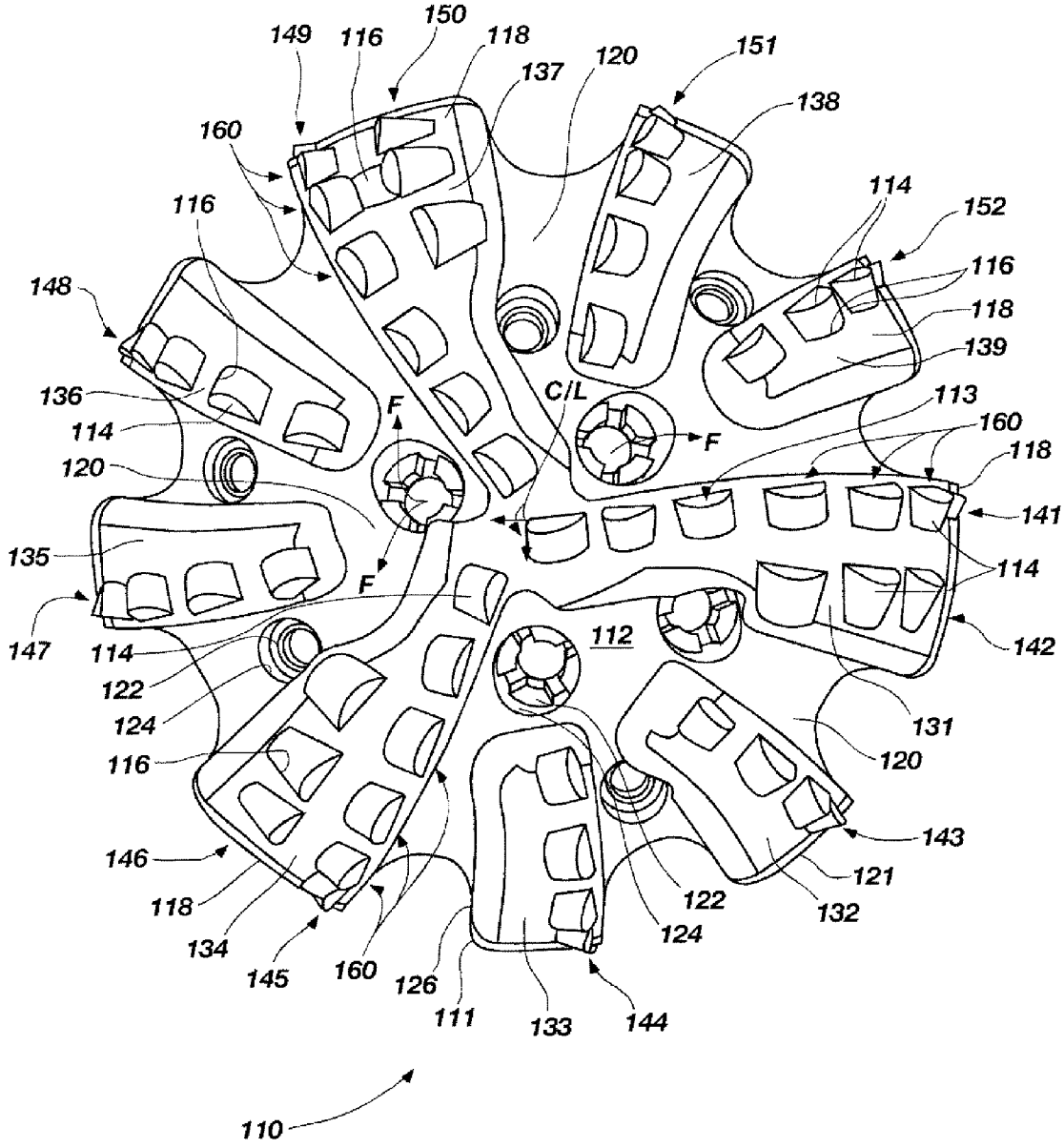
FIG. 1 shows a face view of a rotary drag bit in accordance with a first embodiment of the invention.

FIG. 1 shows a face view of a rotary drag bit 110 in accordance with a first embodiment of the invention. While the rotary drag bit 110 of this embodiment comprises nine pilot or cutter sets 160, it is contemplated that the drag bit 110 may include one cutter set or a plurality of cuter combination sets greater or less than the nine illustrated. Before turning to a detailed description of the cutter sets 160, the general description of the drag bit 110 is first discussed.

The rotary drag bit 110 as viewed by looking upwardly at its face or leading end 112 as if the viewer were positioned at the bottom of a bore hole. Bit 110 includes a plurality of cutting elements or cutters 114 bonded, as by brazing, into pockets 116 (as representatively shown) located in the blades 118 extending above the face 112 of the drag bit 110, as is well known to those of ordinary skill in the art. The drag bit 110 depicted is a matrix body bit, but the invention is not so limited. The bit may also be formed as a so-called "steel body" or other bit type. "Matrix" bits include a mass of metal powder, such as tungsten carbide particles, infiltrated with a molten, subsequently hardenable binder, such as a copper-based alloy. Moreover, while this embodiment of the invention includes blades 118 extending above the face 112 of the bit 110, the use of blades 118 is not critical to, or limiting of, the present invention.

Fluid courses 120 lie between blades 118 and are provided with drilling fluid by nozzles 122 secured in nozzle orifices 124, orifices 124 being at the end of passages leading from a plenum extending into a bit body 111 from a tubular shank at the upper, or trailing, end of the bit 110. Fluid courses 120 extend to junk slots 126 extending upwardly along the side of bit 110 between blades 118. Gage pads (not shown) comprise longitudinally upward extensions of blades 118 and may have wear-resistant inserts or coatings on radially outer surfaces 121 thereof as known in the art. Formation cuttings are swept away from the cutters 114 by drilling fluid F emanating from nozzles 122 and which moves generally radially outwardly through fluid courses 120 and then upwardly through junk slots 126 to an annulus between the drill string from which the bit 110 is suspended and supported. The drilling fluid F provides cooling to the cutters 114 during drilling and clears formation cuttings from the bit face 112.

Each of the cutters 114 in this embodiment are PDC cutters. However, it is recognized that any other type of cutting element may be utilized with the embodiments of the invention presented. For clarity in the various embodiments of the invention, the cutters are shown as unitary structures in order to better describe and present the invention. However, it is recognized that the cutters 114 may comprise layers of materials. In this regard, the PDC cutters 114 of the current embodiment each comprise a diamond table bonded to a supporting substrate, as previously described. The PDC cutters 114 remove material from the underlying subterranean formations by a shearing action as the drag bit 110 is rotated by contacting the formation with cutting edges 113. As the formation is cut, the flow of drilling fluid F comminutes the formation cutting and suspends and carries the particulate mix away through the junk slots 126 mentioned above.

Figure 3:
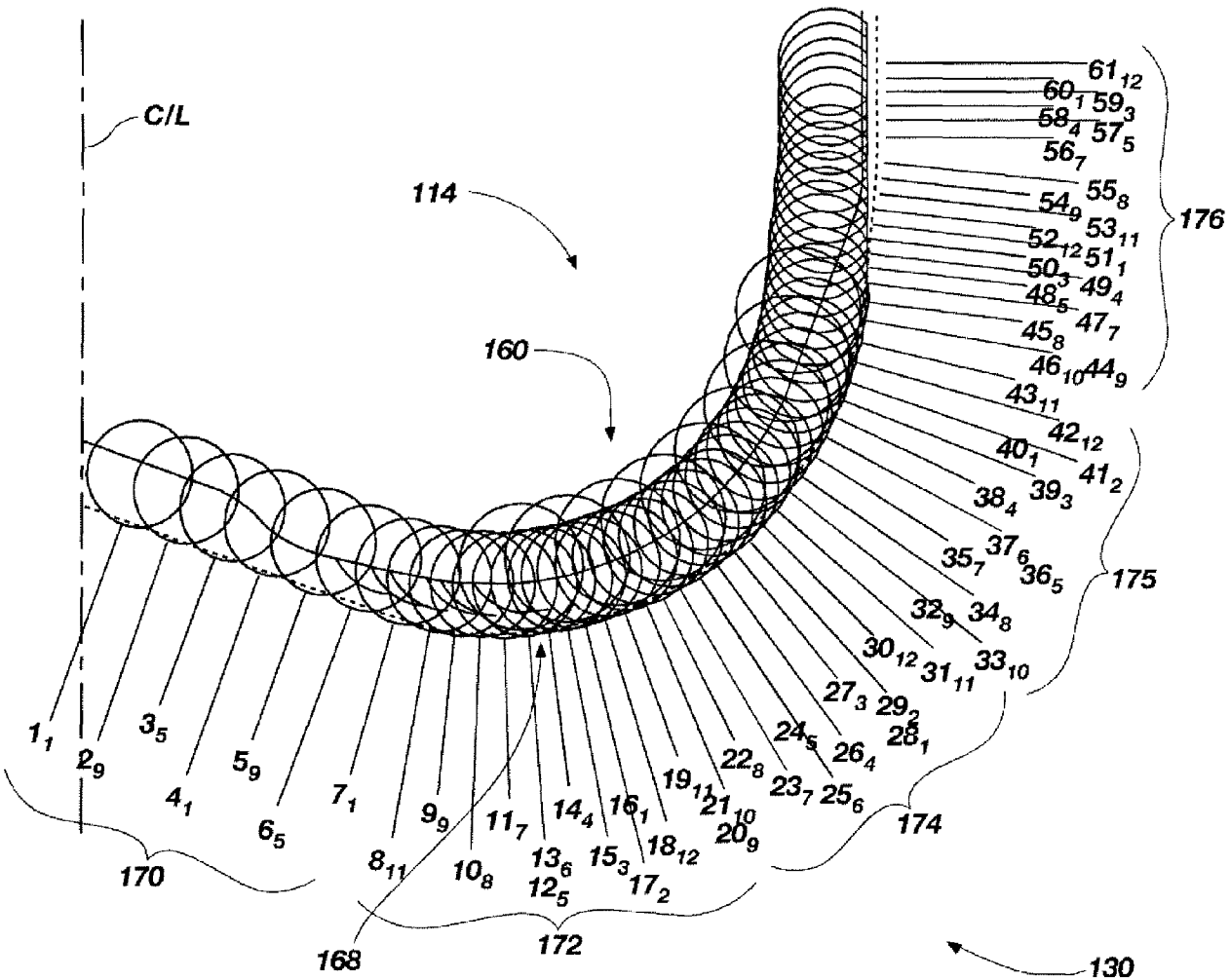
FIG. 3 shows a cutter and blade profile for the first embodiment of the invention.

The blades 118 comprise primary blades in the form of first, fourth and seventh blades 131, 134, and 137, respectively, and further comprise secondary blades in the form of second, third, fifth, sixth, eight and ninth blades 132, 133, 135, 136, 138, and 139, respectively. Each blade 118 generally projects longitudinally from the face 112 and extends generally radially outwardly thereover to the gage of the bit body 111. The plurality of cutters 114 are arranged upon the blades 131, 132, 133, 134, 135, 136, 137, 138, 139 as shown by a cutter and blade profile 130 in FIG. 3. Each of the cutters 114 shown in FIG. 3 are representative of cutter placement upon the bit body 111 as understood by a person of skill in the art of cutter profiles, are numbered 1 through 61 extending from lead lines and will be referenced by the same numerals 1 through 61, respectively, for purposes of describing this embodiment of the invention. Each of the cutters 1 through 61 include a subscript numbered between 1 and 12 indicating its placement within cutter rows 141 through 152, respectively, arranged upon the blades 118. Each cutter row 141 through 152 rotationally trails the cutter row immediately preceding it. For example, cutters 16 and 17 include subscripts 1 and 2, respectively, indicating that the cutter 16 belongs to the first cutter row 141 and the cutter 17 belongs to the second cutter row 142 rotationally trailing the first cutter row 141. Cutters 16 and 17 are both disposed upon the first blade 131. While the cutters 114 are placed in twelve rows upon the drag bit 110 having nine blades, the drag bit 110 may have any suitable number of cutter rows or any number blades. Specifically, embodiments of the invention are particularly suited for a drag bit having two cutter rows disposed upon one blade. A cutter row may be determined by a radial path extending from the centerline C/L of the face 112 of the drag bit 110 and may be further defined by having one or more cutting elements disposed substantially along or proximate to the radial path.

The Cutter sets 160 include: cutters 12/13; cutters 16/17; cutters 20/21; cutters 24/25; cutters 28/29; cutters 32/33; cutters 36/37; cutters 40/41; and cutters 44/46. The cutter sets 160 are located primarily in a nose region 172, a flank region 174 and a shoulder region 175 of the bit body 111. The cutter sets 160 may also be located in the cone region 170 and the gage region 176 of the bit body 111, or in any given region, without limitation.

Figure 4:
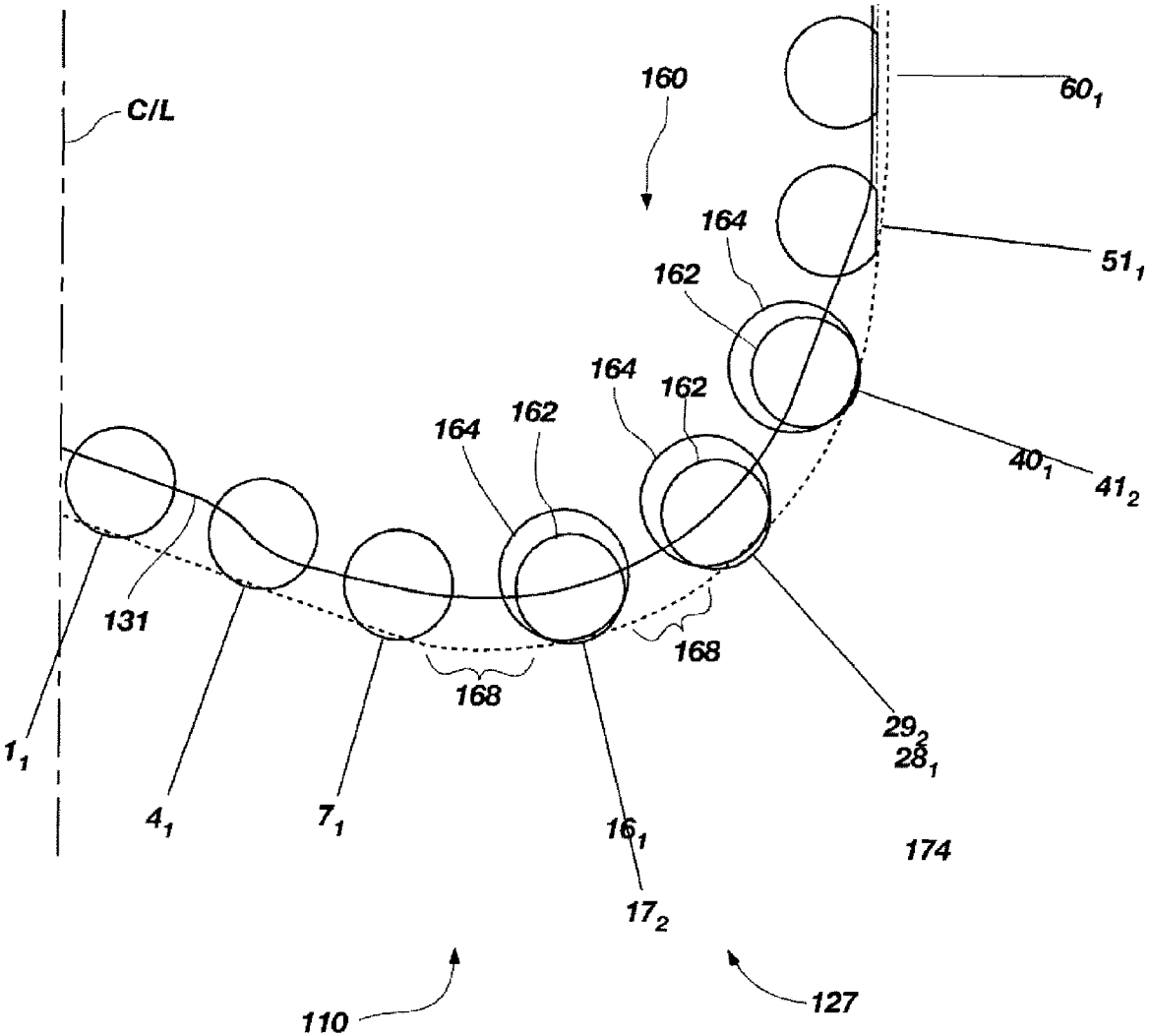
FIG. 4 shows a cutter profile for a first blade of the bit of FIG. 1.
Figure 5:
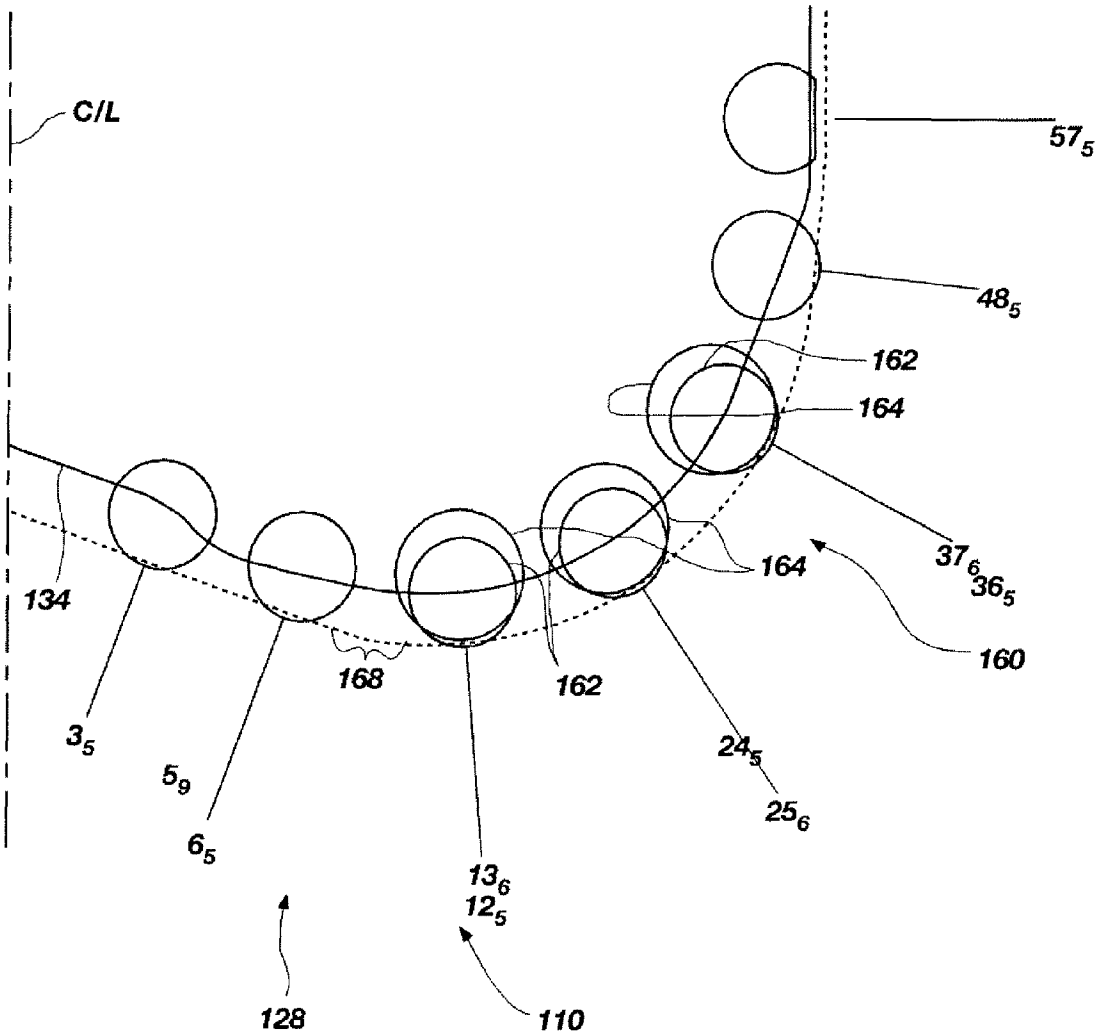
FIG. 5 shows a cutter profile for a fourth blade of the bit of FIG. 1.

Each cutter set 160 includes a pilot cutter 162 of relatively smaller lateral extent rotationally leading a primary cutter 164 of relatively larger lateral extent in substantially the same rotational path, at substantially the same radius from the centerline C/L. The cutter sets 160 are illustrated in profile in FIG. 4 which shows a cutter profile 127 for a first blade 131, in FIG. 5 which shows a cutter profile 128 for a fourth blade 134, and in FIG. 6 which shows a cutter profile 129 for a seventh blade 137 for the drag bit 110, respectively. For example, primary cutter 17 rotationally trails pilot cutter 16 along substantially the same rotational path as shown in FIG. 4. Optionally, a cutter set 160 may be placed upon any blade, e.g., primary, secondary or tertiary blades, without limitation, but are included upon the primary blades 131, 134, 137 in this embodiment.

Figure 6:
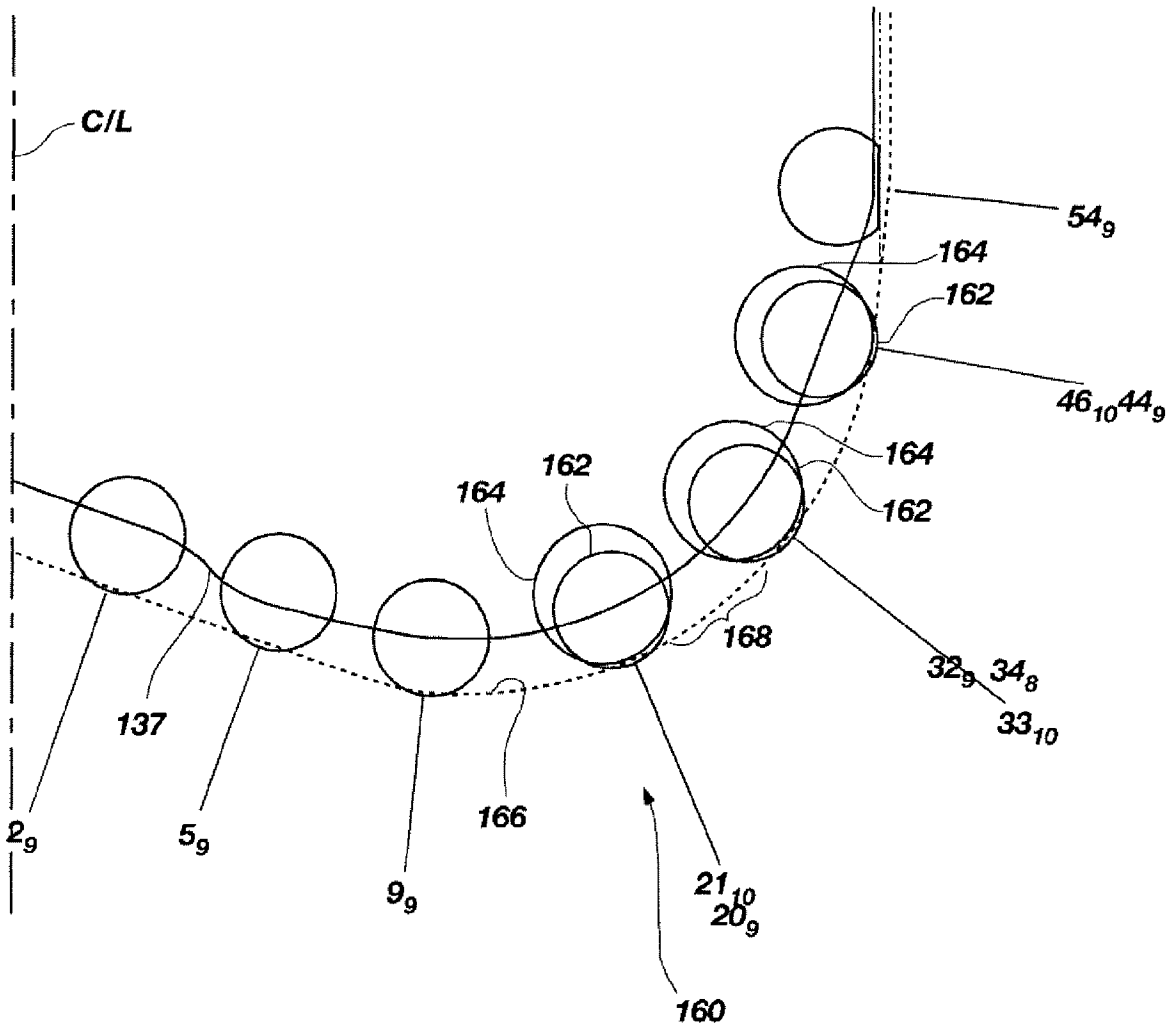
FIG. 6 shows a cutter profile for a seventh blade of the bit of FIG. 1.

The pilot cutter 162 may have a particular exposure to the formation, the exposure being the extent to which a cutter protrudes above the surrounding bit face, such as the face of a blade 137 as illustrated in FIG. 6. The cutters distributed along one or more blades together exhibit a cutter profile as shown in FIGS. 3 through 6 and identified at 166 in FIG. 6. In use, the cutters engage the formation to a depth of cut usually limited by the surrounding surface on the bit face to which each cutter is mounted, but in other instances limited by so-called penetration or depth of cut limiters, as is well known in the art. The larger, primary cutter 164, rotationally trailing the pilot cutter 162, is under exposed with respect to the pilot cutter 162. While the larger, primary cutter 164, is under exposed with respect to the pilot cutter 162 in this embodiment of the invention, the primary cutter 164 may have the same exposure. The underexposure may, of course, be varied based upon formation characteristics, relative cutter sizes, cutter shapes, the presence or absence of chamfers on the cutting faces of the cutters, cutter backrakes, rotational spacing between cutters, and other factors. In this regard the selected underexposure is an engineered exposure. Also, the engineered exposure of a pilot cutter may include the same exposure with respect to other primary cutters. In this configuration the smaller, more highly exposed pilot cutter 162 is enabled to apply focused energy applied to the bit from weight on bit (WOB) and bit rotation to pre-fracture the formation while the larger cutter 164 clears and widens the cut made in the formation by the pilot cutter 162. The larger cutter 164 may have any under exposure such that it remains in subsequent contact with the formation while substantially trailing the pilot cutter 162 prior to other cutters 114 cutting the uncut formation material when cutting along the rotational path spaces 168 between cutters on the depicted blade.

Figure 2:
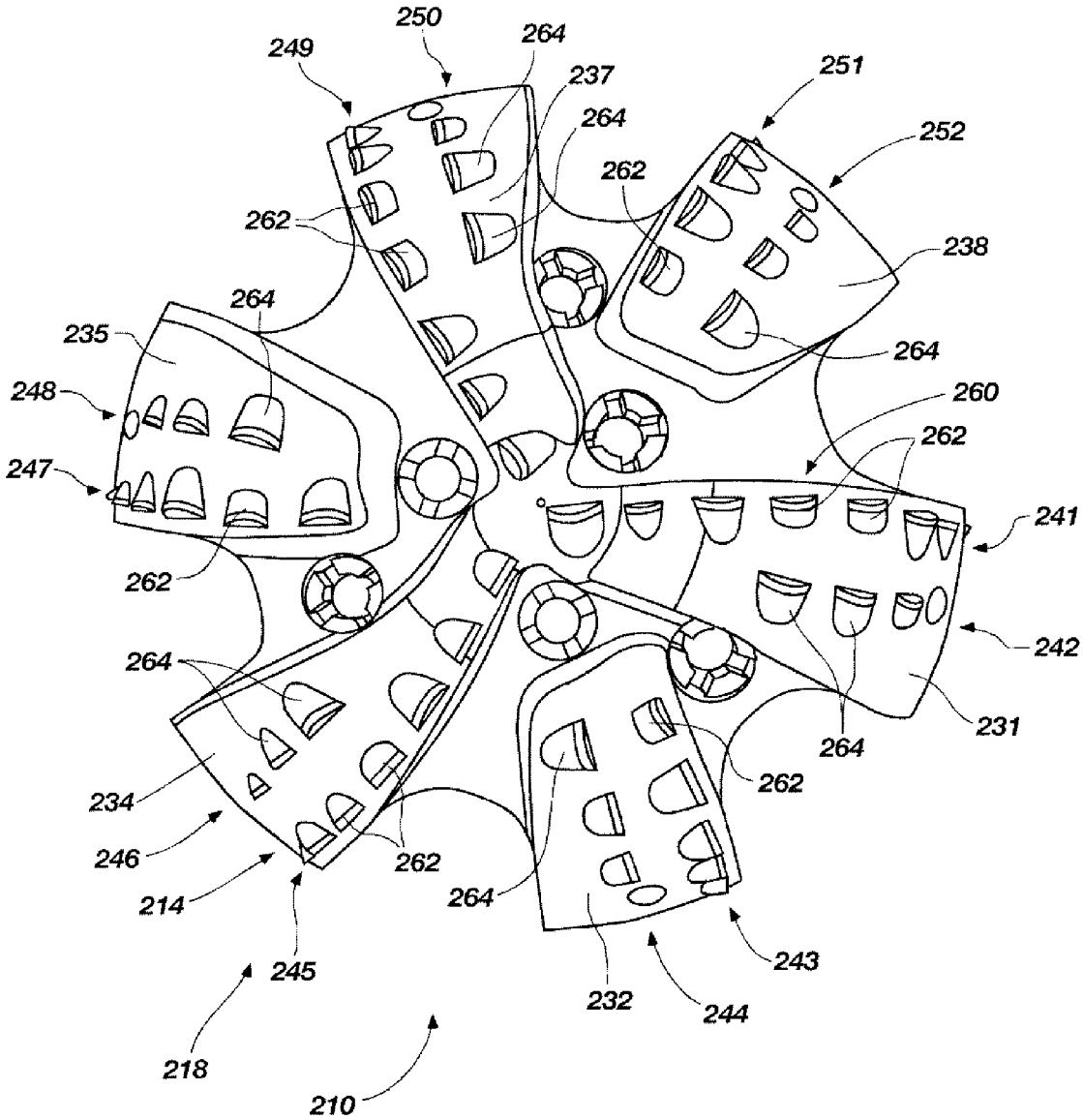
FIG. 2 shows a face view of a rotary drag bit in accordance with a second embodiment of the invention

FIG. 2 shows a frontal view of a rotary drag bit 210 in accordance with a second embodiment of the invention. Simultaneous reference may be made to FIG. 12, which shows a cutter profile 230 for the second embodiment of the invention. The rotary drag bit 210 comprises six blades 218 and a plurality of cutters 214 coupled thereto. For purposes of describing FIGS. 2 and 12 of the second embodiment of the invention, the cutters are numerically numbered between 1-57, and the drag bit 210 also include wear knots numerically numbered 58-62. In this regard, the cutter numerals 1 through 61 for the first embodiment of the invention is not to be confused with the cutter numerals 1 through 57 and the wear knot numerals 58 through 62 as shown in the cutter profile 230 in FIG. 12 for the second embodiment of the invention. The blades 218 include three primary blades 231, 234, 237 and three secondary blades 232, 235, 238. Each of the cutters 1-57 and each of the wear knots 58-62 include a subscript numbered between 1 and 6 indicating its placement upon blades 231, 232, 234, 235, 237, 238, respectively, and further arranged within cutter rows 241 through 252 for each blade 231, 232, 234, 235, 237, 238.

The cutters 214 are arranged in first cutter rows 241, 243, 245, 247, 249, 251 and in second cutter rows 242, 244, 246, 248, 250, 252 on blades 231, 232, 234, 235, 237, 238, respectively. The second cutter rows 242, 244, 246, 248, 250, 252 each rotationally trail the first cutter rows 241, 243, 245, 247, 249, 251, respectively preceding them. The cutters 214 include smaller cutting elements 262 in first cutter rows 241, 243, 245, 247, 249, 251 leading larger cutting elements 264 in second cutter rows 242, 244, 246, 248, 250, 252 in order to pre-fracture or improve fracturing of a formation during drilling. In this regard, the smaller cutting elements 262 in first cutter rows 241, 243, 245, 247, 249, 251 may be considered "pilot" cutter set 260 when paired with respective larger, primary cutting elements 264 in second cutter rows 242, 244, 246, 248, 250, 252 disposed substantially along or proximate to the radial path created by the smaller cutting elements 262.

Figure 12:
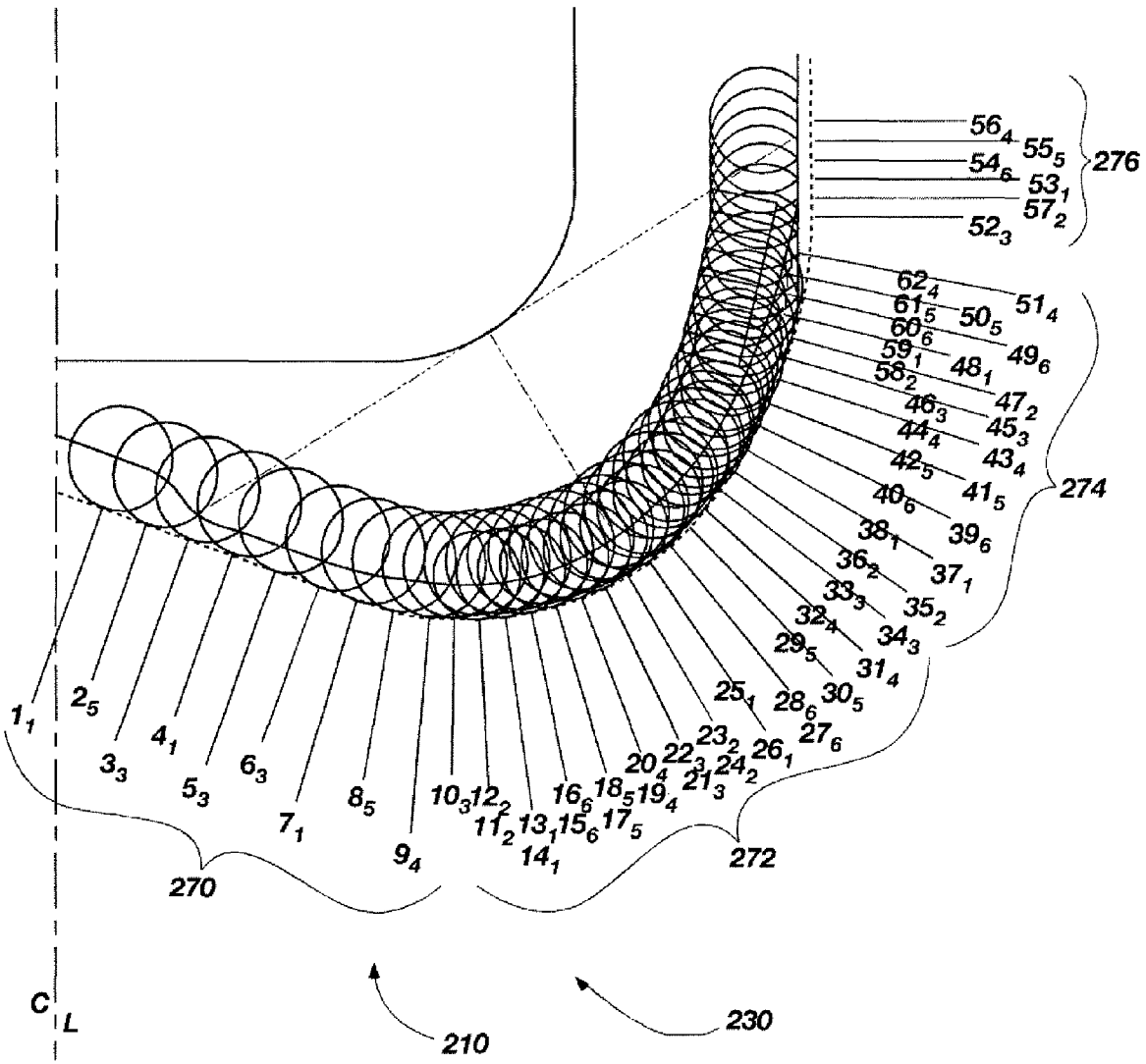
FIG. 12 shows a cutter profile for the second embodiment of the invention.

In this embodiment of the invention, the cutter sets 260 are located substantially in a nose region 272, of the drag bit 210. The cutters 214 located within the nose region 272 experience significant cutter load, by providing cutter sets 260 the work load distributed across cutters 262 and 264 improving removal of formation material while decreasing individual cutter loading. The cutter sets 260 may also be located in a cone region 270, a shoulder region 274 and the gage region 276 of the bit body 111, or in any given region, without limitation. The cutter sets 260 include cutters 11/12, 13/14, 15/16, 17/18, 19/20, 21/22, 25/26, 29/30 and 33/34 as shown in FIG. 12.

In this embodiment of the invention, the smaller cutting element 262 is a pilot or core cutter providing a primary means of fracturing a formation allowing the larger cutting element 264 with its larger diameter coming in behind, i.e., rotationally following, the smaller cutting element 262 to further remove the formation. The larger cutting element 264 shears the formation material as in conventional drag bits, but because the formation has already been fractured, and thus weakened, by the rotationally leading smaller cutting element 262, the cut may be completed with less energy. In this regard, it is easier for the larger cutting element 264 to remove the formation material weakened but unremoved by the smaller cutting element 262 without being exposed to as much stress.

In another aspect, the same amount of formation removal is accomplished with the smaller "pilot" cutting element 262 in front of the larger cutting element 264, allowing the smaller cutting element 262 to leave a smaller footprint on the working formation in terms of wearflat area (discussed below) allowing the cutter combination 260 (smaller cutting element 262 in front of the larger cutting element 264) to maintain an improved efficiency for a longer period of time as the cutters 214 wear, (again in terms of wearflat area as discussed below).

Figure 7A:
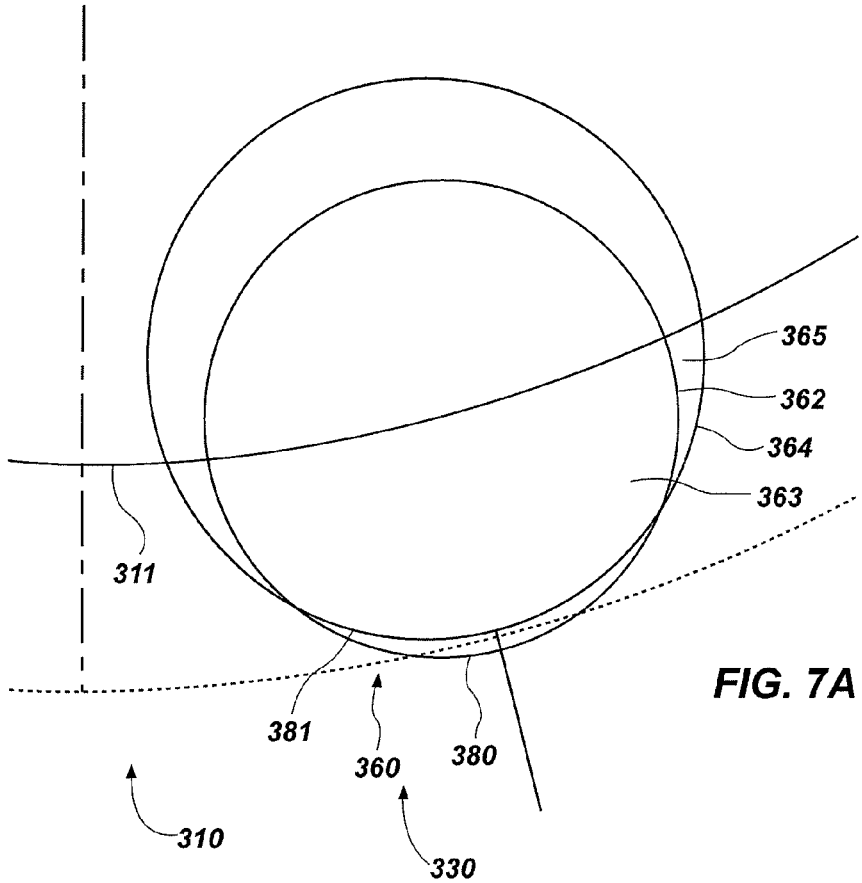
FIG. 7A shows a cutter profile for a bit having a cutter set in accordance with a third embodiment of the invention.

FIG. 7A shows a cutter profile 330 for a bit 310 having a cutter set 360 in accordance with a third embodiment of the invention. The cutter set 360 includes a first cutter 362 and a second cutter 364, both being coupled to a bit body 311 of the bit 310. The second cutter 364 is larger than the first cutter 362, and is underexposed with respect to and rotationally trails the first cutter 362. While the second cutter 364 rotationally trails the first cutter 362, it need only rotationally trail in a substantially adjacent or similar rotational or helical path created by the rotation of the bit 310. Assuming that the applied force for fracturing the formation is held constant upon the bit 310, the first cutter 362 may apply greater stress upon the formation because of its smaller face surface area 363 and engaged cutting edge in comparison to the second cutter 364 with its larger face surface area 365. In this regard, the first cutter 362 may provide the primary force for pre-fracturing a formation due to its greater applied force per unit area, while the second cutter 364 is able to clear and open the cut made in the formation with its lower applied force per unit area.

Figure 11:
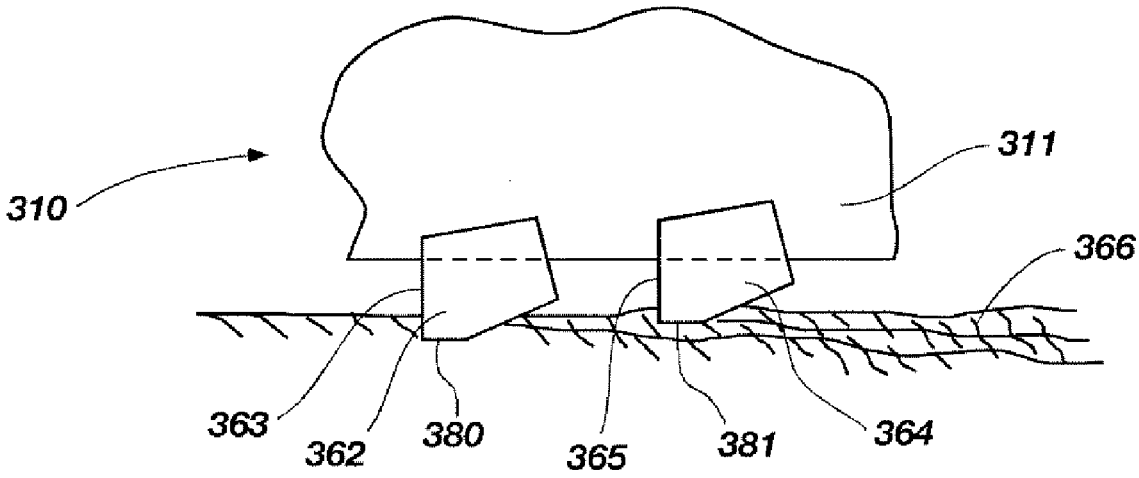
FIG. 11 shows an illustration of the cutter set in accordance with the third embodiment of the invention.

Initially, at the time of formation drilling, i.e., before wearflat areas develop upon the cutters 114, the energy supplied by the drill string primarily is transmitted into the cutters 362 and 364 and through their face surface areas 363 and 365, respectively, providing stress upon the formation 366 to fracture it (the penetration force). Reference may also be made to FIG. 11, wherein it is shown that as the cutters 362 and 364 wear, wearflat areas develop upon the normal cutter surfaces 380 and 381, respectively. As the wearflat areas increase or grow on the normal cutter surfaces 380 and 381 the indentation force increases, requiring a greater WOB to effect a given depth of cut. While the energy transfer effect is true for conventional cutters, the embodiments of the invention advantageously harness and control the growth of the wearflat areas by optimizing interaction of the cutter set 360 to maintain a lesser required WOB during drilling by reducing cutter wear, which enhances and prolongs the life of the drag bit 310.

Figure 7B:
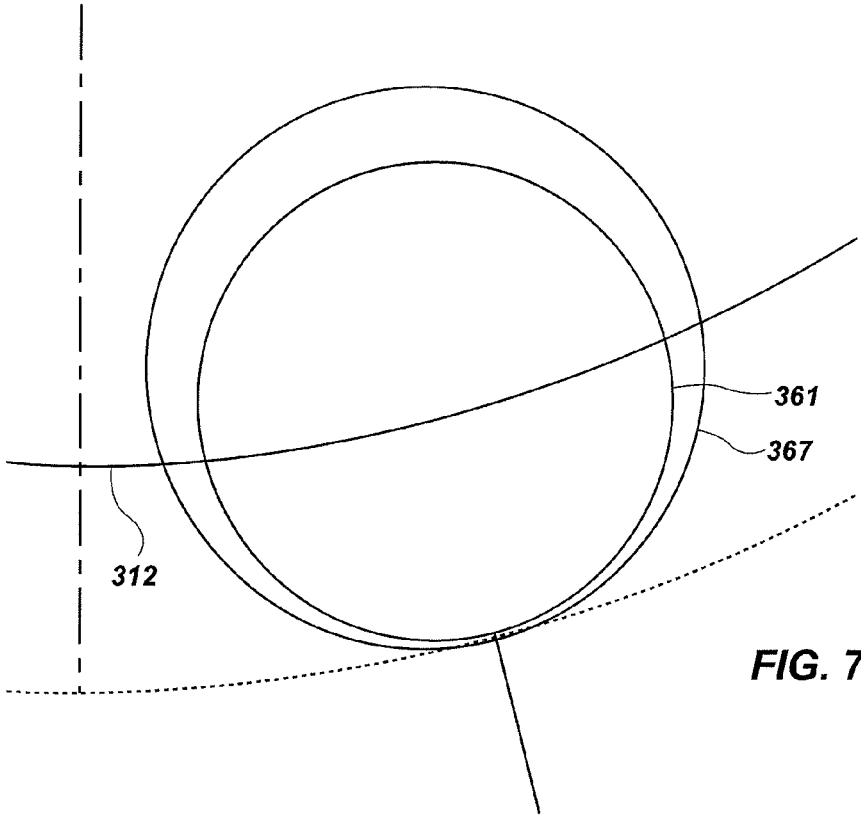
FIG. 7B shows another bit having at least one pilot cutter having a first exposure lesser than a second exposure of at least one primary cutter in accordance with another embodiment of the invention.

FIG. 7B shows another embodiment of a rotary drag bit, the rotary drag bit having a bit body 312 with a face and a longitudinal axis, the bit body 312 configured to rotate about the axis. The rotary drag bit further including at least one pilot cutter 361 disposed at a radius from the longitudinal axis and including a cutting surface of a first lateral extent protruding at least partially from the face at a first exposure and at least one primary cutter 367 disposed at substantially the same radius from the longitudinal axis and including a cutting surface of a second, greater lateral extent protruding at least partially from the face at a second exposure. In this embodiment, the first exposure of the at least one pilot cutter 361 is lesser than the second exposure of the at least one primary cutter 367.

In embodiments of the invention, the life of a drag bit is increased as compared to a substantially equivalent, conventional drag bit. Specifically, by using a smaller diameter or lateral extent, rotationally leading cutter with a wider or trailing space before a larger cutter of greater lateral extent or diameter follows in the same radial path, less cutter density is needed, i.e., cutter density is decreased when compared with a similar conventional bit, although the cutter count may be the same. The cutter density, in effect, leaves a smaller footprint upon the formation as compared to a conventional bit having the same number of cutters, enabling greater penetration as the cutters wear. In this regard, the smaller footprint by the cutters upon the formation improves the energy transfer, particularly in terms of the force being applied to the drill bit which is utilized more efficiently by the cutters for a longer period of time.

Figure 10:
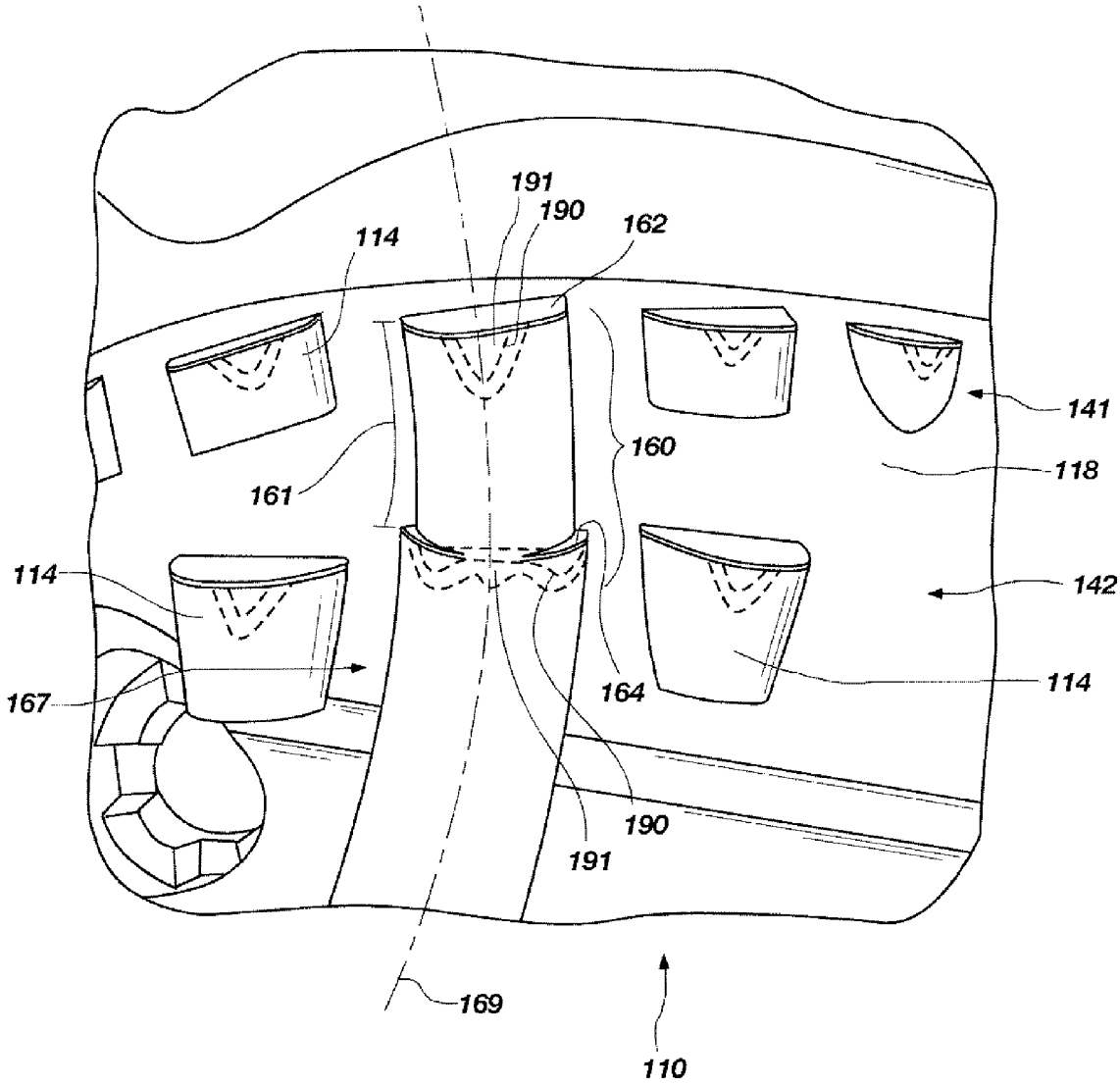
FIG. 10 shows a representative formation cut segment for a bit having one cutter combination set in accordance with the first embodiment of the invention.

FIG. 10 shows a representative formation cut segment 167 for a bit 110 having one cutter combination set 160 in accordance with the first embodiment of the invention. The cut segment 167 is shown as if looking toward the bit 110 when looking up from the bottom surface of a bore hole in a formation. The set 160 comprises a smaller cutter 162 rotationally leading or in front of a larger cutter 164. Both cutters 162, 164, of the set 160, are aligned on a blade 118 of a bit body of the bit 110 in combination in order to facilitate pre-fracture and removal of subterranean formation to achieve the cut segment 167 when drilling. The cutting face of the larger cutter 164 trails the cutting face of the smaller cutter 162 by a rotational segment or space 161 and cutters 162, 164 are placed on the blade 118 such that the center of both cutters 162, 164 lie in slightly different or substantially the same radial paths. The radial path 169 is representative of the helical path the cutters 162, 164 travel when cutting the formation during drilling. The larger cutter 164 is slightly underexposed with respect to the smaller cutter 162. In this regard, the smaller cutter 162 pre-factures the formation after which the underexposed larger cutter 164 enlarges the cut segment 167 and removes additional formation material while cutting. The amount of underexposure will be determined by the desired ROP and the rotational segment or space 161. In this embodiment, as the desired ROP is increased or the rotational space 161 is increased, the designed underexposure of the cutter 164 will necessarily increase in order to allow the smaller cutter 162 to primarily contact the formation with the larger cutter 164 trailing to open up the cut segment 167.

As with other embodiments of the invention, the rotational space 161 between the cutters 162, 164 may be such that the smaller cutter 162 is aligned within a first cutter row 141 with other cutters 114 and the larger cutter 164 is aligned within a second cutter row 142 having other cutters 114. Optionally, the rotational space 161 may be larger or smaller such that placement of either cutter 162, 164 is in its own cutter row.

As depicted, smaller cutter 162 and the larger cutter 164 are both PDC full round face cutters providing suitable cutting capability for multiple formations types. Optionally, the smaller cutter 162 and larger cutter 164 may each be made from different cutting element materials, e.g., TSP, without limitation, and may include various cutter shapes, e.g., scribed cutters, without limitation, suitable for cutting different formation types.

Representatively, FIG. 10 shows the formation cut segment 167 before the cutters 162, 164 begin to develop wearflats. As the bit 110 wears, wearflats 190 develop upon the cutters 162, 164. As the bit 110 continues to wear, the surface area 191 of the wearflats 190 continues to increase. The other cutters 114 also develop wearflats as the bit 110 wears. The wearflats 190 represent the cutter area of the cutters coming in contact generally in the axial or normal direction of the bit 110 with respect to the formation. As the surface area 191 of the wearflats 190 increase, the force required to penetrate the formation with the cutters increases and resultantly reduces the amount of force (or energy) available for penetration causing the ROP to decrease. Also, as the bit 110 wears, the increase in energy transfer to penetrate the formation accelerates the rate of wearflat growth and ultimately shortens the life of the bit 110. Advantageously, the life of the bit 110 is extended by the cutter combination set 160 when compared to a conventional bit. The cutter combination set 160 distributes the work load upon the cutters 162, 164. Specifically, the smaller cutter 162 pre-fractures the formation and the larger cutter 164 enlarges the cut in the pre-fracture formation, which lowers the stress upon the cutter set 160 allowing the wearflat area 191 of the bit 110 to increase at a lower rate for a given ROP.

Figure 8:
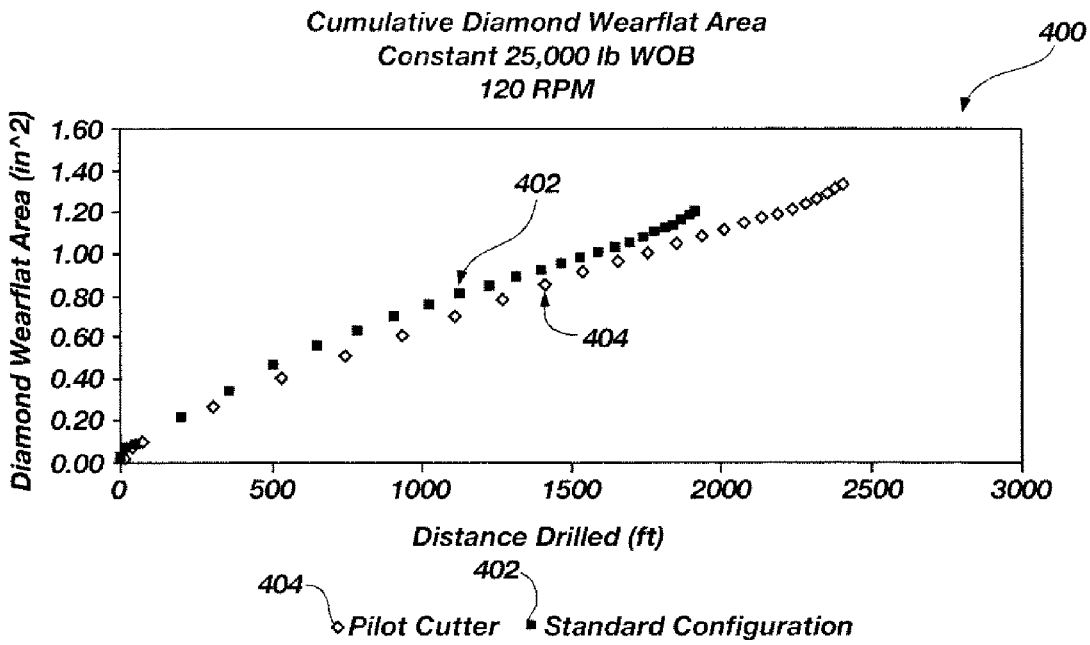
FIG. 8 is a graph of cumulative diamond wearflat area during simulated drilling conditions.
Figure 9:
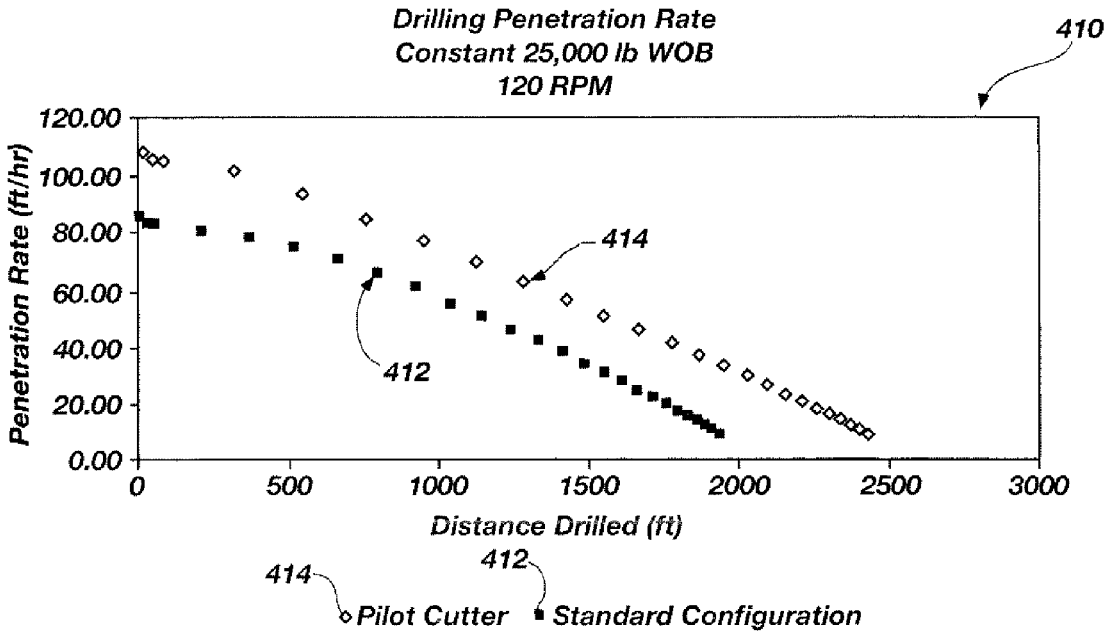
FIG. 9 is a graph of drilling penetration rate during simulated drilling conditions.

Performance improvement obtained through use of an embodiment of the invention is shown in FIGS. 8 and 9. FIG. 8 is a graph 400 of cumulative diamond wearflat area and FIG. 9 is a graph 410 of drilling penetration rate, for two different drag bits simulated under the same drilling conditions.

The graph 400 of FIG. 8 includes a vertical axis indicating total diamond wearflat area of all the cutting elements in square inches, and a horizontal axis indicating distance drilled in feet. The graph 410 of FIG. 9 includes a vertical axis indicating penetration rate (or ROP) in feet per hour, and a horizontal axis indicating distance drilled in feet. The results shown in FIGS. 8 and 9 were based upon a computer model of the drag bits drilling a vertical hole in a single, hard abrasive sandstone formation while maintaining 25,000 lbs WOB at a constant bit rotation of 120 RPM over the entire drill run. The bits were 7⅞ inches in size and included the same number of bit blades. Also, the simulation maintained the bit temperatures at 100° C. by providing cooling fluid to the bits. Further, there where no dynamic dysfunctions and offset forces in the model of the simulation.

The responses 402 and 412 shown in FIGS. 8 and 9, respectively, are of a conventional bit. The responses 404 and 414 shown in FIGS. 8 and 9, respectively, are for a pilot cutter bit according to an embodiment of the invention. Both bits have the same number of cutting elements; in this regard the conventional bit and the pilot cutter bit are functionally identical in design. However, the actual diamond or cutter density for the conventional bit was greater than that for the pilot cutter bit, i.e., the diamond density of the pilot cutter bit was less because of smaller or pilot cutting elements used. Diamond or cutter density is a measure of the cutter area, cutter size and the cutter volume of all the cutters on a bit, for example, without limitation. Looking at graph 400, the response 402 of the wearflat area of the conventional bit increases at a faster rate than the response 404 of the wearflat area of the pilot cutter bit. In this regard, the life of the pilot cutter bit is extended beyond the life of the conventional bit.

Looking at graph 410, the response 414 shows penetration rate of the pilot cutter bit is greater than the penetration rate shown in response 412 for the conventional bit for a given distance drilled, correspondingly correlating to wearflat area for the same distance drilled as shown in graph 400. Accordingly, by providing a bit configured according to an embodiment of the invention, the rate of wearflat area increase of the cutting elements is reduced and reduction in ROP over the course of the run is also reduced for a given distance drilled as compared to a conventional bit.

Also, the penetration rate, i.e., response 414 of the pilot cutter bit is greater than the penetration rate, i.e., response 412, of the conventional bit at a given distance drilled, in part because the "pilot cutter" bit has lower cutter density, despite the fact that both bits have the same cutter count. In this regard, as the cutters of the pilot cutter bit wear, a smaller "footprint" or wearflat area is comparatively maintained over the life of the bit, providing more force, i.e., energy, to removing and penetrating the formation and less force into the "footprint" or wearflat area. In the conventional bit, more force, i.e., energy, is transferred into its "footprint" or wearflat area comparatively because of its larger diamond density, which accelerates the growth of the wearflats and decreases its drilling life.

In embodiments of the invention, the primary or larger cutters may be spaced together as close as possible without interfering with other cutters. Because the pilot or smaller cutters lead the larger cutters, the pilot cutters will be spaced wider apart and the cutter density will be less than conventionally expected for a similar bit profile. Increasing the spacing of the pilot and larger cutters improves the life of the bit by leaving a smaller "imprint" or wearflat area as compared to conventional bit cutter and further improves penetration rate over the life of the drag bit as the cutters wear. Further, by increasing the spacing of the cutters by having pilot cutters upon the drag bit allows more bit or blade body material to surround the cutters, providing additional surface area to absorb any impact or dynamic dysfunctional energy that might damage the primary cutters or the pilot cutters.

In embodiments of the invention, the primary or larger cutters may have an engineered exposure. The engineered exposure may include the same exposure for a pilot cutter and the primary cutter rotationally trailing the pilot cutter in substantially the same rotational path where the pilot cutter includes a smaller cutter density than the primary cutter.

In other embodiments of the invention, all of the primary or larger cutters may have an engineered exposure and all of the pilot cutters may have an engineered exposure. The engineered exposure may include the same exposure for all of the pilot cutters and all of the primary cutters rotationally trailing each of the pilot cutters in each of the substantially same rotational path for each pilot cutter and each primary cutter groupings. Each of the pilot cutters includes a smaller cutter density than each of the primary cutters.

In still other embodiments of the invention, all of the secondary cutters may have an engineered exposure and all of the pilot cutters may have an engineered exposure. The engineered exposure may include the same exposure for all of the pilot cutters and all of the secondary cutters rotationally trailing each of the pilot cutters in each of the substantially same rotational path for each pilot cutter and each secondary cutter groupings. Each of the pilot cutters includes a smaller cutter density than each of the primary cutters.

In yet another embodiment of the invention, all of the primary cutters may have an engineered exposure. The engineered exposure may include the same exposure for all of the primary cutters. Some of the primary cutters are positioned upon a blade of the bit body approximately trailing a junk slot that immediately rotationally precedes the blade, and other primary cutters rotationally trail their respective pilot cutters on the blade in substantially same rotational path for each pilot cutter and each primary cutter grouping. At least one of the pilot cutters includes a smaller cutter density than the primary cutter that it rotationally trails on the blade.

While particular embodiments of the invention have been shown and described, numerous variations and alternate embodiments will occur to those skilled in the art. Accordingly, it is intended that the invention be limited in terms of the appended claims.

What is claimed is:

1. A rotary drag bit, comprising:

a bit body with a face and a longitudinal axis, the bit body configured to rotate about the axis;

at least one pilot cutter disposed at a radius from the longitudinal axis and including a cutting surface of a first lateral extent and surface area protruding at least partially from the face at a first exposure; and at least one primary cutter disposed at substantially the same radius from the longitudinal axis as the at least one pilot cutter and including a cutting surface of a second, greater lateral extent and surface area protruding at least partially from the face at a second exposure, the at least one primary cutter positioned to clear and widen the cut made by the at least one pilot cutter when drilling.

2. The rotary drag bit of claim 1, wherein the at least one pilot cutter leads the at least one primary cutter, taken in a direction of intended bit rotation.

3. The rotary drag bit of claim 1, wherein the second exposure of the at least one primary cutter is an engineered exposure having an underexposure relatively equal to or lesser than the first exposure of the at least one pilot cutter.

4. The rotary drag bit of claim 1, wherein the second exposure of the at least one primary cutter is lesser than the first exposure of the at least one pilot cutter.

5. The rotary drag bit of claim 1, wherein the first exposure of the at least one pilot cutter is lesser than the second exposure of the at least one primary cutter.

6. The rotary drag bit of claim 1, wherein the at least one of the at least one pilot cutter and the at least one primary cutter is one of a TSP cutter and a PDC cutter.

7. The rotary drag bit of claim 1, wherein the bit body further comprises at least one blade extending from the face and the at last one pilot cutter and the at least one primary cutter are coupled to the blade.

8. A rotary drag bit comprising:

a bit body with a face and a longitudinal axis, the bit body configured to rotate about the longitudinal axis; and at least one cutter set comprising two cutters, each cutter including a cutting surface protruding at least partially from the face of the bit body to an exposure, and one of the two cutters positioned at substantially the same radius from the longitudinal axis so as to substantially follow the other of the two cutters along a cutting path upon rotation of the bit body about the longitudinal axis and clear and widen the cut made by the other cutter, each of the two cutters having a cutting surface with a different surface area and a different exposure.

9. The rotary drag bit of claim 8, wherein the two cutters of the at least one cutter set comprises a first cutting element having a relatively smaller surface area and a second cutting element of a relatively larger surface area rotationally trailing the first cutting element, the second cutting element being underexposed with respect to the first cutting element.

10. The rotary drag bit of claim 8, wherein the bit body comprises at least one blade extending from the face and having a first cutter row and a second cutter row rotationally trailing the first cutter row, and the two cutters of the cutter set comprises a first cutting element having a cutting surface of relatively lesser surface area positioned in the first cutter row and a second cutting element having a cutting surface of relatively greater surface area positioned in the second cutter row.

11. The rotary drag bit of claim 10, wherein the second cutting element is underexposed relative to the first cutting element.

12. The rotary drag bit of claim 10, wherein the first cutter row and the second cutter row extend generally radially outward from the longitudinal axis of the bit body.

13. A pilot drag bit comprising:

a bit body with a face, an axis, at least one blade extending from the face and at least one fluid course extending generally radially outward from the axis upon the face and rotationally leading the at least one blade, the bit body configured to rotate about the axis;

a pilot cutter disposed at a radius from the axis and coupled to the at least one blade, wherein the pilot cutter is adjacent to and rotationally trailing the at least one fluid course; and a primary cutter disposed at substantially the same radius from the axis as the pilot cutter and coupled to the at least one blade, the primary cutter remote from and rotationally trailing the at least one fluid course, the primary cutter having a lateral extent greater than a lateral extent of the pilot cutter, and the primary cutter rotationally trailing the pilot cutter, the primary cutter positioned to clear and widen the cut made by the pilot cutter when drilling.

14. The pilot drag bit of claim 13, wherein the primary cutter rotationally trails the pilot cutter in substantially the same cutting path.

15. The pilot drag bit of claim 13, wherein the primary cutter is underexposed with respect to the pilot cutter.

16. The pilot drag bit of claim 13, wherein the primary cutter rotationally trails the pilot cutter in substantially the same cutting path and the primary cutter is underexposed with respect to the pilot cutter.

17. A method to pre-fracture a subterranean formation using a rotary drag bit including a pilot cutter configuration comprising:

providing a rotary drag bit comprising a bit body with a face and an axis, the bit body configured to rotate about the axis, and at least one pilot cutter set comprising two cutters, each cutter including a cutting surface protruding at least partially from the face of the bit body, and one of the two cutters positioned so as to substantially rotationally follow the other of the two cutters along a cutting path upon rotation of the bit body about its axis; and rotating the rotary drag bit under weight on bit to engage a subterranean formation with a rotationally leading cutter of the at least one pilot cutter set to prefracture the formation and remove a portion of formation material along the cutter path to form a cut and to engage the formation with the rotationally following cutter laterally outside of the portion engaged with the rotationally leading cutter to remove additional formation material from each side of the cut formed by the rotationally leading cutter.

18. The method of claim 17, further comprising avoiding substantial engagement of the formation immediately below the rotationally following cutter therewith.

19. The method of claim 17, wherein providing a rotary drag bit comprising at least one pilot cutter set comprises providing a plurality of pilot cutter sets.

20. The method of claim 19, wherein the at least one pilot cutter set comprises PDC cutting elements.

21. A rotary drag bit, comprising:

a bit body with a face and a longitudinal axis, the bit body configured to rotate about the axis;

at least one pilot cutter disposed at a radius from the longitudinal axis and including a cutting surface of a first lateral extent and surface area protruding at least partially from the face at a first exposure; and at least one second cutter disposed at substantially the same radius from the longitudinal axis as the at least one pilot cutter and including a cutting surface of a second lateral extent and surface area, the second lateral extent and surface area different than the first lateral extent and surface area, protruding at least partially from the face at a second exposure, the second exposure different than the first exposure, and the at least one second cutter positioned to clear and widen the cut made by the at least one pilot cutter when drilling.

22. The rotary drag bit of claim 21, wherein the at least one second cutter trails the at least one pilot cutter, taken in a direction of intended bit rotation.

23. The rotary drag bit of claim 21, wherein the second lateral extent and surface area of the at least one second cutter is greater than the first lateral extent and surface area of the at least one pilot cutter.

24. The rotary drag bit of claim 21, wherein the second exposure of the at least one second cutter is an engineered exposure having an underexposure relative to the first exposure of the at least one pilot cutter.

* * * * *

UNITED STATES PATENT AND TRADEMARK OFFICE

CERTIFICATE OF CORRECTION

PATENT NO. : 7,896,106 B2
APPLICATION NO. : 11/862440
DATED : March 1, 2011
INVENTOR(S) : David Gavia It is certified that error appears in the above-identified patent and that said Letters Patent is hereby corrected as shown below:

In the specification:

COLUMN 5, LINE 17, change "The Cutter sets 160" to --Cutter sets 160--

Signed and Sealed this
First Day of October, 2013

Teresa Stanek Rea

Teresa Stanek Rea
*Deputy Director of the United States Patent and Trademark Office*